United States Patent [19]

Wennberg et al.

[11] 3,951,730

[45] Apr. 20, 1976

[54] COMPRESSIBLE CONSTRUCTION

[76] Inventors: Lennart Arne Wennberg; Barbro Christina Wennberg, both of Hjortronvagen 59, 196 31 Kungsangen, Sweden

[22] Filed: Mar. 23, 1973

[21] Appl. No.: 344,061

[30] Foreign Application Priority Data

Mar. 27, 1972 Sweden ..... 3919/72

[52] U.S. Cl. ..... 428/116; 108/112; 229/14 BE; 229/14 H; 229/14 C; 248/174; 248/346; 206/521; 206/814; 220/DIG. 9

[51] Int. Cl. ..... B65d 65/44

[58] Field of Search ..... 229/14 C, 14 BE, 14 H; 108/112; 248/174, 346

[56] References Cited

UNITED STATES PATENTS

| | | | |
|---|---|---|---|
| 2,513,880 | 7/1950 | Lang | 248/174 X |
| 2,539,966 | 1/1951 | Orovig | 229/14 C |

FOREIGN PATENTS OR APPLICATIONS

| | | |
|---|---|---|
| 103,760 | 10/1945 | Sweden |

*Primary Examiner*—Huckert John W.
*Assistant Examiner*—Charles Gorenstein

[57] ABSTRACT

The present invention relates to a compressible construction to be used as isolation or as packing material, comprising equidistant bellow-like compressible layers, which are interconnected by a zigzag folded strip which is alternately connected to the layers. Short projecting parts are positioned between the zigzag strip and the layers to add support. In the folded compressed condition when not in use, the construction has a very small volume, while in the expanded condition it is able to act as a heat insulator and pressure, shock and vibration resistor. Important features of this construction are its small volume as it can be compressed when not in use, its ability to isolate from heat, to resist pressure, shocks and vibrations.

10 Claims, 3 Drawing Figures

COMPRESSIBLE CONSTRUCTION

BACKGROUND OF THE INVENTION

At present many different isolation- and packing materials are used. Most of them are based on the principle of air enclosed in small cavities e.g. air enclosed by wool, mineral fibres, synthetic fibres and paper such as corrugated paper. A problem these materials have in common is their large volume when not in use. The present invention solves this problem by a construction that can be compressed when not in use.

BRIEF SUMMARY OF THE INVENTION

The present invention is a construction which consists of at least two separated layers of material. The layers are, equidistantly placed in a, bellow-like compressible manner. A zigzag folded sheet is placed between the layers and attached alternately therebetween along the whole length of the layers. Perpendicularly projecting parts are attached to the layers between the zigzag sheet. The length of the projecting parts correspond mainly to the distance between the layers. The advantage of this invention is its small volume when compressed. This is important when the material is transported and stored. Other advantages of the construction are its good ability to resist pressure, shocks, vibrations and heat flow. An object of this invention is to provide an isolation and packing material that can be compressed when not in use. Another object is to provide a structure which has the ability to resist shocks, vibrations, pressure and heat-flow. The invention can be used as an isolation material in the building industry as a packing material and when there is a need for a structure to have the ability to endure strains such as pressure, strikes and vibrations. It can also be used as an isolation material, such as underneath a sleeping bag.

DETAILED DESCRIPTION

Figure 1:
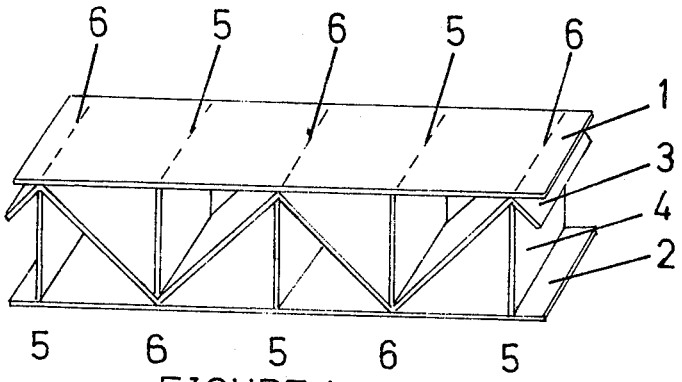
FIG. 1 is a perspective of the construction consisting of two layers, one zigzag folded sheet and projecting parts.
Figure 2:
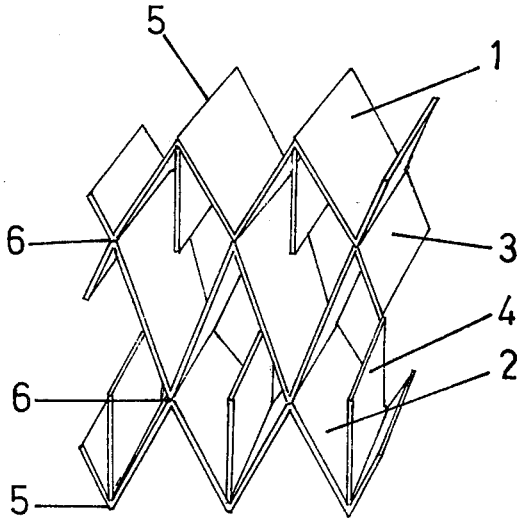
FIG. 2 is a perspective of the same construction when it is partially compressed.
Figure 3:
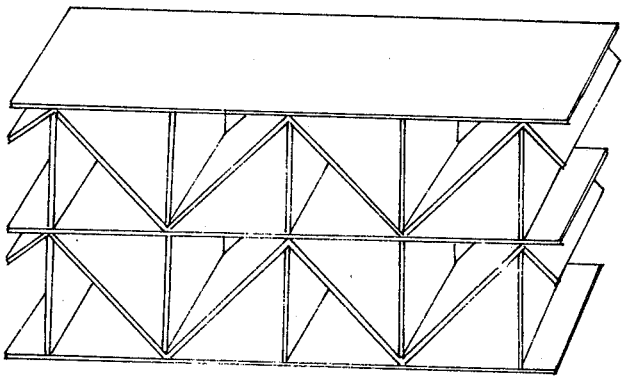
FIG. 3 is a perspective of a construction consisting of three layers, two zigzag folded sheets and projecting parts.

Referring to FIG. 1 the present invention is a construction consisting of at least two separated layers of material 1 and 2. The layers 1 and 2 are bellow-like compressible along a number of lines 5 and 6 which are equidistantly situated thereon. A zigzag folded sheet 3 is placed between the layers 1 and 2 and attached alternately between the layers along the whole length of every second line 6. Between the layers perpendicularly projecting parts 4 are attached to the layers at the remaining lines 5. The length of these projecting parts 4 correspond mainly to the distance between the layers, so that the free end of the projecting part is positioned close to the at the attached fold 6 opposite layer of the zigzag folded sheet 3. The projecting parts 4 have such a length that their free ends rest against the angular points on the zigzag folded strip. When the construction is partly compressed it has the appearance of FIG. 2. The dimensions of sheet 3 and projecting parts 4 are chosen so that they do not overlap each other when the construction is completely compressed. At the compression the air is squeezed out of the construction. Thus its volume is considerably reduced. In order to ensure the maintenance of the arrangement in expanded condition, a straight, stiff rod or band-like means can be applied along the longsides parallel to the compression direction. This means can also be made in a u-shape where the shanks of the U are applied along sides of the arrangement which are perpendicular to the compression direction. A construction can be built up by three or more layers like the construction described above. When building up a construction of three or more layers the layers are placed in such a way that the zigzag folded sheets run parallel to each other. FIG. 3 shows a view of a system consisting of three layers with two zigzag folded sheets and projecting parts. This system is also compressible in the same manner as with the previous embodiment. In order to get a good isolating quality the layers 1 and 2 can be covered by a reflecting material. When choosing material for in the system included components some elements ought to be taken into consideration. Generally speaking, the layer material should have a good tensile strength and to a certain degree be yielding. Possible layer material is for instance, paper, plastic, textile and rubber. A material of good stiffness should be chosen. Paper, rubber or plastic but also metal, wood or similar materials are useable. For the zigzag folded strip which folds can be fixed in the folds of the layers by way of gluing, hinges or in a similar manner, it is necessary to choose a material, of medium but not too great stiffness, such as paper, plastic, metal or rubber.

Even though a special version of the invention has been described it is realized that modifications and variations easily can be conceived and thus the patent protection should be considered to include even such modifications and equivalents which can be considered to be in the scope of the following patent claims.

What is claimed is:

1. A compressible construction comprising a first layer having a first set of fold lines adapted to fold inwardly and alternating therewith a second set of fold lines adapted to fold outwardly a second layer having a first set of fold lines adapted to fold inwardly and alternating therewith a second set of fold lines adapted to fold outwardly a zigzag folded sheet positioned between the layers and attached alternately to set first said of fold lines of said first layer and said first set of fold lines of said second layer a plurality of perpendicular parts attached at one end to said second set of fold lines of said first layer and projecting toward said zigzag folded sheet.

2. The construction of claim 1 including a second plurality of perpendicular parts attached at one end to said second set of fold lines of said second layer and projecting toward said zigzag folded sheet.

3. The construction of claim 2 wherein a second end of said parts and a second end of the second parts about the zigzag sheet and are unconnected thereto.

4. The construction of claim 3 wherein the length of said parts and second parts is substantially the same as the distance between the first and second layers.

5. The construction of claim 4 wherein the layers are of a good tensile strength material.

6. The construction of claim 5 wherein the material is one taken from the group consisting of paper, plastic, rubber and textile.

7. The construction of claim 6 wherein the inside of the first layer is covered by a reflective coating.

8. The construction of claim 7 wherein the parts and second parts are constructed of a stiff material.

9. The construction of claim 8 wherein the zigzag folded strip is constructed of a material which is not as stiff as the parts and second parts.

10. The construction of claim 9 including a third layer having a first set of fold lines adapted to fold inwardly and alternating therewith a second set of fold lines adapted to fold outwardly, a second zigzag folded sheet positioned between the second and third layers and attached alternately to said second set of fold lines of said second layer and said first set of fold lines of said third layer and a third plurality of perpendicular parts attached at one end to said second set of fold lines of said third layer and projecting toward said second zigzag folded sheet.

* * * * *